United States Patent [19]

Bartholic et al.

[11] Patent Number: 4,804,459

[45] Date of Patent: Feb. 14, 1989

[54] PROCESS FOR UPGRADING TAR SAND BITUMEN

[75] Inventors: David B. Bartholic, Watchung; William J. Reagan, Englishtown, both of N.J.

[73] Assignee: Engelhard Corporation, Menlo Park, N.J.

[21] Appl. No.: 67,433

[22] Filed: Jun. 25, 1987

Related U.S. Application Data

[63] Continuation of Ser. No. 719,939, Apr. 4, 1985, abandoned.

[51] Int. Cl.[4] ..... C10G 29/04

[52] U.S. Cl. ..... 208/253; 208/177; 208/127; 208/435

[58] Field of Search ..... 208/253, 177, 127

[56] References Cited

U.S. PATENT DOCUMENTS

| | | | |
|---|---|---|---|
| 2,905,595 | 9/1954 | Berg | 208/11 R |
| 2,921,018 | 1/1960 | Helmers et al. | 208/114 |
| 2,944,002 | 7/1960 | Faulk | 208/91 |
| 2,956,004 | 8/1960 | Conn et al. | 208/91 |
| 2,987,470 | 6/1961 | Turkin | 208/253 |
| 3,024,203 | 3/1962 | Strecker | 252/413 |
| 3,150,075 | 9/1964 | Russell et al. | 208/120 |
| 3,165,462 | 1/1965 | Friedman et al. | 208/86 |
| 3,320,152 | 5/1967 | Nathan et al. | 208/11 R |
| 3,966,586 | 6/1976 | Owen et al. . | |
| 4,043,899 | 8/1977 | Anderson et al. | 208/161 |
| 4,051,022 | 9/1977 | Myers et al. | 208/253 |
| 4,082,646 | 4/1978 | Flynn | 208/11 R |
| 4,161,442 | 7/1979 | Audih et al. | 208/11 R |
| 4,243,514 | 1/1981 | Bartholic | 208/91 |
| 4,256,567 | 3/1981 | Bartholic | 208/252 |
| 4,263,128 | 4/1981 | Bartholic | 208/127 |
| 4,309,274 | 1/1982 | Bartholic | 208/127 |
| 4,328,091 | 5/1982 | Bartholic | 208/91 |
| 4,374,021 | 2/1983 | Bartholic | 208/251 |
| 4,384,949 | 5/1983 | Reagan et al. | 208/91 |
| 4,412,914 | 11/1983 | Hettinger, Jr. et al. | 208/253 |
| 4,419,225 | 12/1983 | Kukes et al. | 208/253 |
| 4,427,539 | 9/1984 | Busch et al. | 208/253 |

OTHER PUBLICATIONS

Haseltine et al., U.S. application Ser. No. 383,160, filed May 28, 1982 now abandoned.

Haseltine U.S. patent application Ser. No. 557,412 filed Nov. 30, 1983 as file wrapper continuation of Ser. No. 383,160, now aban.

Bartholic U.S. patent application Ser. No. 06/662,666 filed Oct. 19, 1984, now abandoned.

*Primary Examiner*—Curtis R. Davis
*Assistant Examiner*—Helane Myers
*Attorney, Agent, or Firm*—Inez L. Moselle

[57] ABSTRACT

A method for upgrading a concentrate of tar sands bitumen containing colloidal clay in which solvent-diluted bitumen is contacted for a short time in a riser with hot attrition-resistant substantially catalytically inert fluidizable microspheres, causing a selective vaporization of the lighter high hydrogen content components of the bitumen. A portion of the heavier asphaltenes and most of the components which contain metals, sulfur and nitrogen remain on the attrition-resistant microspheres. Colloidal clay in the bitumen feed also deposits on the microspheres instead of being carried over with the vaporized hydrocarbon product. The contact material, with deposit, is passed to a burner provided with high velocity air jets which attrites the colloidal clay away from the microspheres and the material removed by attrition is recovered. The heated microspheres are reintroduced into the riser for further contact with incoming diluted bitumen charge.

9 Claims, 3 Drawing Sheets

SYNTHETIC CRUDE OIL FROM TAR SAND BITUMEN

PROCESS FOR UPGRADING TAR SAND BITUMEN

This is a continuation of co-pending application Ser. No. 06/719,939 filed on Apr. 4, 1985, now abandoned.

BACKGROUND OF THE INVENTION

This invention relates to a method for upgrading tar sand butumen for the preparation of useful hydrocarbon products therefrom, such as a higher quality syncrude essentially free of metals and asphaltenes and with a much lower molecular weight. In particular, the invention relates to a process for upgrading bitumens derived from tar sands which contain colloidal mineral contaminants generally referred to as colloidal clay.

Extensive deposits of tar sands, bituminous sands, bituminous diatomite and similar materials are known to exist throughout the world. These materials comprise a siliceous matrix of sands, sandstones or diatomaceous earth which is coated or saturated with relatively high molecular weight hydrocarbon materials. These deposits are generally located at or near the earth's surface, although some deposits may be buried by as much as two thousand feet of overburden. It has been estimated that the reserves of petroleum products recoverable from the known deposits of tar sands would be approximately equivalent to the world-wide reserves estimated for conventional crude oil.

As mined, the tar sands are present in general as agglomerates or lumps comprising sand, clay, water and viscous hydrocarbonaceous material called bitumen. While there is no universally accepted definition of "bitumen", it may be characterized as that portion of petroleum that exists in the semi-solid or solid phase in natural deposits. It has been proposed by the United Nations Institute for Training and Research (UNITAR) that Bitumens, or natural tars, be defined as the petroleum component which has a viscosity greater than 10,000 mPa.s (cp) measured at the conditions in the deposit and gravity greater than 1,000 kg/m$^3$ (less than 10° API) at standard conditions of 15.6° C. (60° F.) and a pressure of one atmosphere. The definition was suggested at the Second International Conference on Heavy Crude and Tar Sands, held in Caracas, Venezuela on Feb. 7–17, 1982. At that time it was also noted that a continuously variable spectrum of properties can be found not only geographically between deposits but also laterally and vertically within a given petroleum occurrence. Accordingly, the proposed definition employs esentially an arbitrary demarcation between bitumen and heavy crudes, when the materials are compared on the basis of these physical properties alone.

Additional distinctions between bitumen and conventional heavy crude oil may be made on the basis of their chemical compositions. Relative to most heavy crudes, bitumen has a large asphaltene component. Asphaltenes are complex, polynuclear hydrocarbons which are insoluble in n-pentane and/or n-heptane. Due to their substantial asphaltene content, bitumens exhibit a high carbon/hydrogen ratio. For the preparation of transportation fuels, it is generally necessary to reduce the carbon/hydrogen ratio by addition of hydrogen through catalytic hydrogenation. Bitumen typically also contains significant amounts of sulfur, nitrogen and metals as contaminants, often substantially more than most conventional heavy crudes.

The predominating mineral component of the material as mined is in most cases a fine quartz sand. It is surrounded by bitumen in quantities of perhaps about 5 to over 20 weight precent of the total composition. In addition, tar sands generally also contain colloidal (minus 2 micron) material, usually referred to as colloidal clay since it contains silica and alumina, in quantities of from about 1 to about 50 weight precent of the total composition.

The bitumen as found in naturally occurring tar sands is not of great economic value in its crude form. Such bitumen, however, may be upgraded to hydrocarbons of lower molecular weight, in particular to hydrocarbons which are liquids at room temperature. Extensive recovery of tar sand oil has not been seriously considered until relatively recently, primarily because of the expense of known recovery and upgrading methods in relation to the cost of preparing the same products from crude petroleum. The rising costs of crude petroleum production and the depletion of known petroleum reserves, however, have made an efficient and economical process for the treatment of such tar sand more and more desirable. The vastness of the known deposits has encouraged many people to look at these raw materials as a potential source for filling energy and chemical feedstock needs in a work of depleting conventional crude oil sources.

Several methods have been developed for purifying tar sands to provide bitumen concentrates that can be used as feedstock for further upgrading to produce useful products. The principal purification technique which has been applied to tar sands in order to concentrate bitumen therefrom is extraction. In one type of extraction commonly known as the "hot water" process, advantage is taken of the fact that tar sands produce a bituminous slurry when mulled with hot water and sodium hydroxide. This slurry divides into two components upon further dilution with hot water in a settling zone. A bituminous froth rises to the surface of the water and is withdrawn for further concentration of bitumen, while essentially bitumen-free sand is discarded as a downward flowing aqueous tailings stream.

Another known beneficiation process for recovery of bitumen from tar sand is known as the "cold water" process. This process comprises the following steps: grinding the ore in the presence of water and a dispersant; flotation with fuel oil, dilution of the bitumen concentrate with solvent; and separation of beneficiated bitumen from the sand/water residue. This process for the preparation of a bitumen concentrate avoids the requirement of large quantities of heat needed to raise the temperature of the water in the process described in the preceding paragraph. In the first stage of preparation, the tar sands as mined are crushed, for example in a gyratory crusher, to form a coarse ore stock pile. Through the use of cone crushers, rod mills and/or ball mills, the latter possibly in closed circuit with cyclones, a product which is approximately 80% below 150 microns may be prepared. Water and a major portion of the conditioning and flotation reagents used in the process are then added to form a slurry. A variety of materials may be added to the crushed tar sand ore prior to conditioning and flotation. Fuel oil or other solvent, in quantities of about 5 lbs. per ton, may be added at this stage. Sodium carbonate (up to about 10 lb/ton) and/or sodium silicate (up to about 5 lb.ton) may also be employed. The slurry is then passed to one or more conditioning tanks. Some conditioning may also be accomplished merely by the flow of slurry through pipes over extended distances.

The sized and conditioned slurry is then fed to a flotation circuit, comprising one or more flotation trains. Each of these trains comprises a rougher/-scavenger unit and a single- or multiple-stage cleaner circuit utilizing flotation cells. A typical retention time in the flotation cells is on the order of 15 minutes. Tails from the scavenger cell are passed to thickeners, to which lime or another suitable flocculant, in an amount of about 5 lb/ton, is added. Overflow water from the thickener is recycled back into the circuit. A tailings slurry at about 50–60% by weight solids is discharged into a tailings pond. Concentrates from the last stage of the flotation process, containing approximately 25 percent by weight bitumen, are then suitable for further concentration, for example, by solvent upgrading. Unfortunately, colloidal clay floats with the bitumen concentrate and is not effectively removed by flotation.

As currently practiced, bitumen concentrate from the flotation process is transferred to a mixing vessel where it is combined with at least one part, and generally several parts, of liquid solvent per part of bitumen. While the exact amount and composition of the solvent is not critical, it has been suggested that for maximum effectiveness the solvent should contain about 20% aromatics. Heretofore, the solvent has been almost entirely recovered in subsequent steps. It is possible to use the same fuel oil for solvent upgrading as is used in the flotation process. The diluted bitumen is pumped into settling or holding tanks, where the remaining water and sands begin to settle out.

The final stage of the solvent upgrading process comprises the solvent or diluent recovery stage. This may be a distillation tower or other mechanism which is used to separate solvent and flotation oils for recycling to upstream stages of the extraction process. Depending on the nature of the charge to the solvent upgrading step and the intended use for the concentrated bitumen, additional separation steps, such as dehydration or centrifugation may be necessary.

In yet another type of extraction process, tar sand agglomerates are contacted with a suitable solvent such as a gas-oil boiling range fraction to produce a solution of bitumen and gas-oil. This solution is separated from the sand and then passed to a conventional hydrocarbon conversion unit.

Treatment of tar sands by these beneficiation techniques in order to separate an enriched bitumen stream from the sand is a substantial component of the recovery costs, above those mining the crude ore. These processes generally provide products which contain colloidal clay even after repeated treatments. Colloidal clay contents of beneficiated bitumen concentrates typically range from 2500 ppm to 7 weight percent, usually below 2 weight percent, based on the weight of the bitumen. Since the colloidal clay forms a stable emulsion with water it cannot be readily removed from the bitumen recovered from tar sands. The water, which may be present in amount up to 15% based on the weight of the bitumen, causes problems in downstream upgrading processes. For example, water causes foaming to take place in cokers. Thus, selective mining has been employed heretofore to minimize the content of clay in bitumen concentrates obtained from tar sands. Tar sands containing high levels of clay are generally not exploited. In addition to colloidal clay, the bitumen concentrates generally contains high levels of sulfur, nitrogen, metals and other contaminants. The residual colloidal clay and high contaminants level have also heretofore presented major problems in the subsequent use of the recovered product.

Retort methods similar to those used in the pyrolysis or thermal cracking of oil shale have also been proposed for the recovery of bitumen from tar sands. The raw tar sand is contacted with spent sand and fluidized by reactor off gas at temperatures above about 900° F. Volatile products are flashed off while coke is deposited through thermal cracking. The coke is burned off in a separate unit at 1200°–1400° F. and the sand recirculated. Substantial amounts of spent sand, for example 5–10 parts per part of raw tar sand, are needed for the process. This makes necessary a very large retort volume per barrel recoverable oil. Serious waste heat and handling problems also arise with this process, making it of little interest commercially.

Once the bitumen has been recovered (concentrated) from the tar sands, two primary bitumen upgrading routes are available: carbon rejection and hydrogen addition. Carbon rejection upgrades bitumen by removing asphaltenes, and is examplified by conventional solvent deasphalting, delayed coking and fluid coking processes. Various modifications of the basic coking and fluid coking processes. Various modifications of the basic coking process have also been proposed. For example, U.S. Pat. No. 2,905,595 describes a process in which tar sands are subjected to a coking process to produce coker gas, gasoline and gas oil and a coke-laden sand stream. The coke-laden sand is contacted with an oxygen-containing gas, such as air, to effect combustion of coke deposited on the sand grains, thereby producing a clean hot sand stream which is recirculated into the process. According to the preferred method described in this patent, coke-laden sands are burned and heated in a specially-designed gas lift furnace. The coke-laden sand is suspended in a plurality of parallel vertical burning zones and recycled through a furnace zone surrounding these vertical tubes. This process produces a distillate product directly. The method essentially employs a recirculated stream of hot solids simultaneously to vaporize, coke and crack the hydrocarbon fraction.

U.S. Pat. No. 3,320,152 describes a process in which tar sand agglomerates are introduced into a feed preparation zone and admixed with relatively hot contact material in order to drive off water and reduce the viscosity of hydrocarbon material, thereby providing a fluidizable mixture of sand particles and hydrocarbons. A portion of the fluidizable mixture is passed through a pressure-developing zone and then introduced into a reaction zone containing a fluidized bed of solid particulate material. This reaction zone is maintained under conditions suitable for carrying out thermal coking of the hydrocarbon material.

U.S. Pat. No. 4,082,646 describes a modified direct coking process in which the combustion stage is divided into two sequential operations. In the first operation, coke solids produced in a reaction zone are introduced into a coke burning zone where they are contacted with combustion air and the mimimim amount of supplementary fuel, if any, needed to burn substantially all the coke. Part of these solids is discarded while the remainder, required for heating the coking reaction zone, is introduced into a fuel burner zone. Here the major portion of the supplemental fuel required to maintian heat balance is combined with air or oxygen to heat further the clean solids until their heat contact is sufficient to meet the requirements of the coking reaction zone.

Carbon rejection alone cannot deal with the bitumen upgrading job in a cost effective manner. This is because an extraordinarily high amount of either a coke byproduct or an asphalt byproduct is produced. These by-products necessarily contain high contents of sulfur, metals and ash, rendering the coke or asphalt relatively valueless. Moreover, the production of unnecessary coke or asphalt markedly reduces the yield of lighter, more valuable liquid hydrocarbons. This yield consideration is of particular importance with respect to tar sand processing, where mining represents roughly 80% of the total operating costs. Thus, an increase in usable fuel yields from each ton of ore can result in disproportionately large overall cost savings.

U.S. Pat. No. 4,161,442 describes a process in which high temperature solids comprising silica are combined with tar sands in a thermal stripping operation restricted not materially to exceed incipient cracking of the petroleum materials. The operating temperature is limited to within the range of 600° F. to 850° F., and preferably below 800° F. A high oily residue deposited on the sand is used to generate fuel gas by heating to a temperature above 1500° F. with addition of steam or air. Since the fluid distillation is operated to minimize cracking, the concentration of residual oil material on the sand is relatively high, and only those components which vaporize below the temperatures of incipient cracking are removed. This process provides only minimal amounts of desirable liquid hydrocarbon products, because of the low process temperatures employed.

An alternative route for the upgrading of bitumen is hydrogen addition. When hydrogen addition is used alone as the upgrading route, the large amounts of hydrogen required to prepare useful products from the hydrogen-deficient asphaltene molecules raises the cost of the fuel produced thereby to unacceptable levels. Moreover, nickel, vanadium and asphaltenes interfere with the hydrogenation and conversion catalysts, shortening run lengths and requiring a more frequent replacement of catalyst. Any fines present in the hydrogen addition feedstock not only block the active sites of the hydrogenation catalyst, thereby reducing its activity, but also lead to the formation over time of obstructions in the flow path of the feedstock through the catalyst bed. This in turn leads to the development of large pressure gradients in the system, ultimately resulting in its shutdown. Combinations of prior art carbon rejection and hydrogen addition processes would only serve to compound the most undesirable characteristics of each.

Another method for deriving useful hydrocarbon products from heavier precursors such as bitumen is the method of catalytic cracking. When catalytic cracking was first introduced in the petroleum industry during the 1930's, the process constituted a major advance over the earlier techniques for increasing pressure to charge catalytic cracking units with heavier crudes and products such as bitumen. Two very effective restraints have limited the extent to which this has been practical: the coke precursor content and the metals, especially heavy metals, content of the feed. As these values rise, the capacity and efficiency of the catalytic cracker are adversely affected.

Polynuclear aromatics, such as asphaltenes, tend to break down during the catalytic cracking process to form coke. This coke deposits on the active surface of the catalyst, thereby reducing its activity level. In general, the coke-forming tendency or coke precursor content of a material can be ascertained by determining the weight percent of carbon remaining after a sample of the material has been pyrolyzed. This value is accepted in the industry as a measure of the extent to which a given feedstock tends to form coke when treated in a catalytic cracker. One method for making this evaluation is the Conradson Carbon Test. When a comparison of catalytic cracking feedstocks is made, a higher Conradson Carbon number (CC) reflects an increase in the portion of the charge converted to "coke" deposited on the catalyst. The Conradson Carbon test has been adopted as an American National Standard and is described in ASTM Method D189. Another generally accepted method for evaluating coke precursor content is the Ramsbottom Carbon test, as described in ASTM Method 524. The Conradson Carbon test, however, is the preferred method for samples that are not mobile below 90° C., such as bitumens.

It has been conventional to burn off the inactivating coke with air to "regenerate" the active surfaces, after which treatment the catalyst is returned in cyclic fashion to the reaction stage for contact with and conversion of additional feedstock. The heat generated in the burning regeneration stage is recovered and used, at least in part, to supply heat for vaporization of the feedstock and for the cracking reaction.

The regeneration stage generally operates under a maximum temperature limitation in order to avoid heat damage to the catalyst. When feedstock with a high CC content is processed, a larger amount of the feedstock in weight percent is deposited as coke on the catalyst than would be the case with low CC feedstock. When this catalyst is regenerated, the additional coke leads to high temperatures in the regenerator. At these higher temperatures, a number of problems arise. The circulation rate of the catalyst is reduced, often resulting in lower conversion rates. Incomplete regeneration of the catalyst may also occur, reducing its catalytic activity. Finally, if the temperature of the regenerator is sufficiently high, an inactivation of the catalyst takes place. There is thus a practical limit to the amount of coke which can be turned per unit time.

As CC of the charge stock is increased, cokeburning capacity becomes the limiting factor, often requiring a reduction in the rate of charge to the unit. Moreover, part of the charge is diverted to an undesired reaction product, thereby reducing the efficiency of the process. Since bitumen comprises to a great extent hydrogen-deficient, high molecular weight hydrocarbons such as asphaltenes, a direct catalytic cracking of bitumen would clearly be a highly inefficient method for upgrading for this reason alone. This is confirmed by Bunger et al., "Catalytic Cracking of Asphalt Ridge Bitumen", *Advances in Chemistry Series,* No. 179, "Refining of Synthetic Crudes". p. 67 (1979). These authors report an inhibited rate of catalytic cracking, low octane numbers for the gasoline produced and substantially higher coke make than experienced presently for commercial gas-oil cracking.

An additional drawback to direct catalytic cracking of bitumen is the metals content of the feed. Most bitumen contain heavy metals such as nickel and vanadium. These metals are deposited almost quantitatively on a catalytic cracking catalyst as the molecules in which they occur are broken down. The deposits of these metals build up over repeated cracking cycles to levels which become troublesome. Some of these metals also unfavorably alter the chemical composition of catalysts. For example, vanadium tends to form fluxes with certain components of common FCC catalysts, lowering their melting point to a degree that sintering begins at FCC operating temperatures with resultant loss of catalytic activity.

The heavy metals present in crude oils are also potent catalysts for the production of coke and hydrogen from the cracking feedstock. The lowest boiling fractions of the cracked product—butane and lighter—are processed through fractionation equipment to recover components of value greater than as fuel for the furnaces. This fraction comprises primarily propane, butane and olefins of like carbon number. Hydrogen, being incondensable in the "gas plant", occupies space as a gas in the compression and fractionation train. As the metals level of the charge stock is increased, hydrogen production becomes the limiting factor, often requiring a reduction in the rate of charge to the unit. Moreover, since bitumen is aleady hydrogen deficient, the generation of additional hydrogen therefrom would be a serious problem.

The sodium content of bitumen also presents problems for a conventional catalytic cracking system. Sodium reacts with a zeolite catalyst to produce the inactive form of zeolite. The product bitumen generally contains at least about 1% water, with significant amounts of sodium compounds dissolved therein. These sodium compounds comprise primarily sodium carbonate and sodium hydroxide, which are conventionally used as conditioning agents in the upgrading of tar sands. These compounds are deposited on the catalyst as the bitumen is subjected to catalytic cracking, and can lead to a substantial deactivation of the catalytic cracking catalyst over time, requiring its replacement. Sodium, like vanadium, also tends to form fluxes with certain FCC catalyst components.

In addition, all of the known processes for preparing bitumen concentrates from tar sands provide products containing at least some residual clay, generally several percent by weight. This clay is of a very fine particle size. Because of the viscosity of the bitumen and the chemical constitution of the components thereof, it has not been possible to remove this clay from the bitumen by conventional methods, such as hydroclone separators or conventional filtration means. This clay, particularly the clay of finest particle size, introduces additional complications in hydrogen addition treatments, as noted above.

THE INVENTION

Accordingly, it is an object of the invention to provide a method for deriving a useful hydrocarbon product from tar sands in an economically acceptable manner.

It is a further object of the invention to provide a method for upgrading bitumen derived from tar sands which maximizes the yield of higher-value middle distillate components, while avoiding the disadvantages of the known upgrading routes for tar sand bitumen.

It is an additional object of the invention to provide a method for upgrading a concentrate of bitumen which is not adversely affected by the content of fine particle size clay and water in the bitumen.

It is another object of the invention to provide a method for upgrading bitumen which results in a product with reduced Conradson Carbon number, sulfur and nitrogen, and a minimized content of metal and colloidal clay.

These and other objects of the invention may be achieved according to the instant invention using a selective vaporization system comprising a contactor, a burner regenerator and an inventory of fluidizable, essentially catalytically inert, attrition-resistant contact material in the form of microspheres about 20 to 150 microns in diameter which continuously circulates between the contactor and the regenerator. A bitumen concentrate derived from tar sand, generally diluted on account of its viscosity with at least an equivalent amount by weight of solvent, such as fuel oil or kerosene, or naphtha or light gas oil product from the selective vaporization system is introduced into the selective vaporization system, optionally dispersed with steam or product gas. The combined feed is connected for a short time with heated contact material, causing a selective vaporization of the lighter high hydrogen content components of the bitumen. A portion of the heavier asphaltenes and most of the components which contain metals, sulfur and nitrogen remain on the particles of the contact material. At the vapor exit of the contactor, a quench stream is generally introduced for rapid cooling of the exiting hydrocarbon products to minimize subsequent thermal cracking.

The rapid application of heat generated within the contactor of the selective vaporization system and carried by the fluidizable, substantially catalytically inert contact material vaporizes most of the hydrocarbon components of tar sand bitumen. The unvaporized components—asphaltenes and compounds bearing metals, nitrogen and sulfur—are deposited on the fluidizable contact material.

Unexpectedly, colloidal clay particles also deposit almost quantitatively as protuberances on the fluidizable particles of substantially catalytically inert contact material instead of being carried over with the vaporized hydrocarbon components of the bitumen, thereby removing colloidal clay from the feedstock to downstream processing units such as hydroprocessing or FCC units. The contact material with its deposit of colloidal clay, metals and hydrogen deficient hydrocarbon is circulated into a burner regenerator provided with cyclones and high velocity air jets where the combustible portion of the materials deposited on the contact material is oxidized and the deposit of clay is attrited off by design of cyclones and air distribution to induce attrition and a ball milling action. The material removed by attrition is recovered in bag houses, cyclones or scrubbers downstream from the regenerator burner. The heated contact material exits the burner and is reintroduced into the contactor for further removal of contaminants from new charge stock. Fresh contact material is introduced into the system and spent contact material withdrawn therefrom on a continuous or semi-continuous basis in order to maintain a predetermined average metal content upon the circulating contact material.

It is fortuitous that colloids remaining in the bitumen concentrate from tars are deposited as attritable protuberances on the circulating inventory of attrition-resistant selective vaporization contact material and that the selective vaporization process can be practiced with burners (regenerators) equipped with cyclones and air jets which attrite the protuberances but do not substantially attrite the particles of contact material. If the colloids accreted on the particles of contact material and were not removed by attrition the particles of contact material would form a dense shell which would grow in size. The resulting material will not be useful in removing metals in a riser unless extremely high addition rate of fresh contact material was to be practiced. This is demonstrated by the following estimation of what would occur if removal of accreted colloids did not take place in a commercial selective vaporization contactor operated with a feed containing 1 wt % colloidal clay (3.5 #/clay barrel), 70 ppm Ni+V and with fresh contact material (hereinafter ARTCAT® contact material) added to control metals level on equilibirium contact material to 30,000 ppm. If no clay were deposited, 1.2 #/barrel of fresh ARTCAT contact material per 100 pp. Ni+V would be needed; hence 0.84 #/barrel of ARTCAT contact material would be needed in the cited case of feed containing 70 ppm Ni+V. If 1 wt. % colloidal clay were permitted to accumulate and form a dense shell the weight of deposited clay per unit weight of fresh ARTCAT would be 4.16#/#ARTCAT contact material (3.5#clay deposited/0.84#ARTCAT material. In other words, the weight of the contact material would be multiplied by a factor of about four and the size would increase correspondingly to levels not suitable for use in a riser. Also, we believe that at these levels the deposited colloidal clay would impart undesirable catalytic cracking properties to contact material originally substantially catalytically inert.

Heat is rapidly removed from the vaporized bitumen components in order to minimize destructive molecular conversion of the non-contaminated, lighter hydrocarbon material. The selective vaporization process thereby minimizes thermal conversion of the product to gas, naphtha or coke. In addition, the hydrogen content of the liquid product is for the most part preserved.

This selective vaporization process, which is a modification of the process disclosed in U.S. Pat. No. 4,263,128, removes from the feedstock most of those contaminants which would poison downstream conversion processes, while retaining those having a high hydrogen content. The teachings of U.S. Pat. No. 4,263,128 are incorporated herein by cross-reference hereto. The selective vaporization process also shifts the range of compounds to the feedstock towards the middle distillate range, thereby reducing residual oils and molecular weight.

The solid contacting agent is essentially inert in the sense that it induces minimal cracking of heavy hydrocarbons by the standard microactivity test conducted by measurement of amount of gas oil converted to gas, gasoline and coke by contact with the solid in a fixed bed. Charge in that test is 0.8 grams of mid-Continent gas oil of 27° API contacted with 4 grams of catalyst during 48 second oil delivery time at 910° F. This results in a catalyst to oil ratio of 5 at weight hourly space velocity (WHSV) of 15. By that test, the solid here employed exhibits a microactivity less than 20, preferably about 10.

The selective vaporization process is operated to minimize molecular conversion of that portion of the hydrocarbon feedstock which is suitable for later catalytic cracking or other methods for producing high octane hydrocarbon products. The asphaltenes present in the bitumen are either converted to lower molecular weight hydrocarbons or deposited on the contact material. The selective vaporization process also removes essentially all of the metals (over 90%, and typically over 95%).

In order to disclose more clearly the nature of the present invention, the following drawing, description and examples illustrating specific embodiments of the invention are given. It should be understood, however, that this is done solely by way of example and is intended neither to delineate the scope of the invention nor the ambit of the appended claims.

Figure 3:
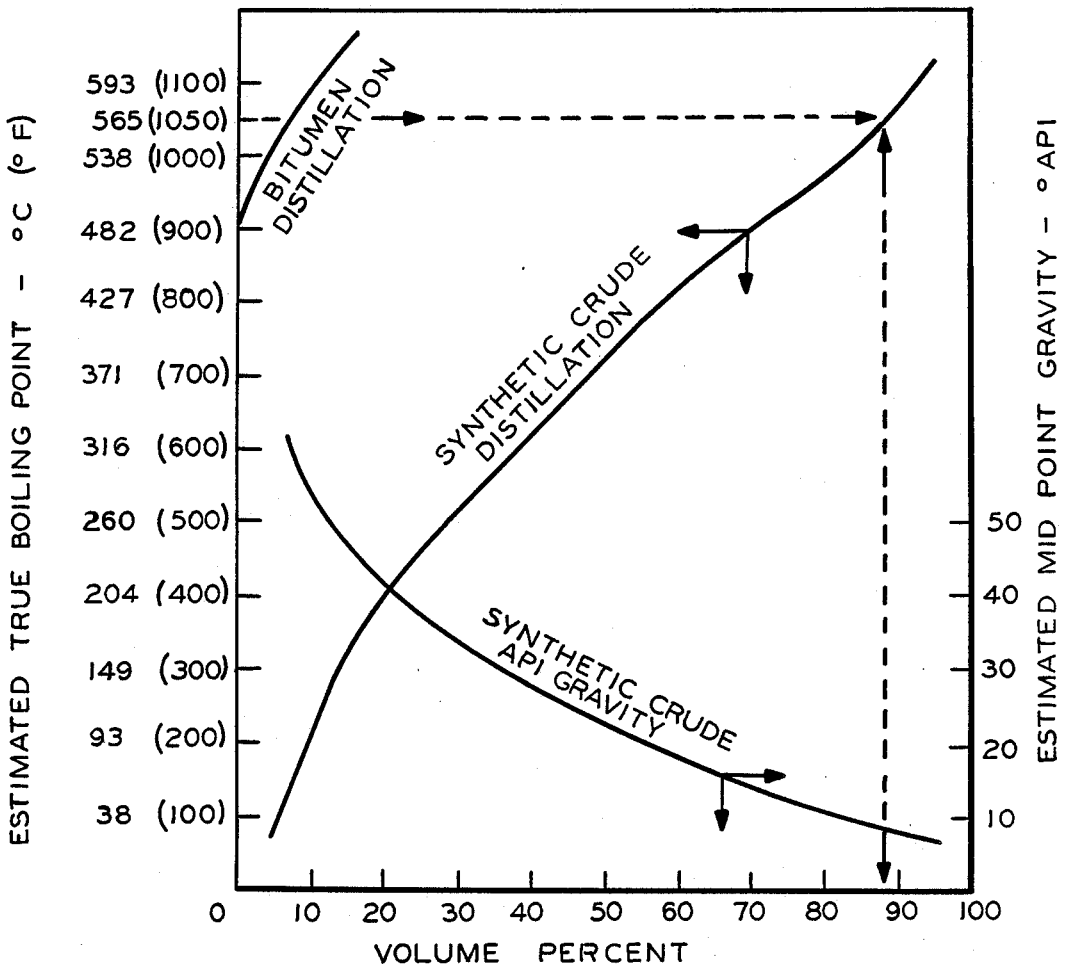

FIG. 3 contains distillation curves of tar and bitumen feedstock and the synthetic crude product obtained therefrom.

DESCRIPTION OF SPECIFIC EMBODIMENTS

In order to cope with the contaminant concentration and the viscosity of tar sand bitumen employed, it is generally desirable to dilute the feedstock unless sufficient solvent is already present. One particularly suitable diluent which may be employed in the selective vaporization process is a clean, light gas oil boiling in the 250°-600° F. range which is produced from tar sand bitumen by the selective vaporization process. This light gas oil material is repeatedly recycled through the selective vaporization process as a captive diluent material. This diluent is practically devoid of carbon residue or metal. In general, at least one equivalent by weight of diluent is used per unit bitumen.

Another suitable diluent for use in the selective vaporization process is the solvent employed during the purification of the bitumen from water and sand. This solvent may be left in large part in the bitumen, rather than being removed by fractionation as customarily done. This results in overall energy savings in the production scheme. Solvent can be allowed to remain, in whole or in part, within the bitumen stream introduced into the selective vaporization process. See the accompanying FIG. 1. This allows for a single fractionation of the purified bitumen, rather than fractionation in two steps—once during the conventional solvent "clean-up" and again during the selective vaporization process.

Figure 1:
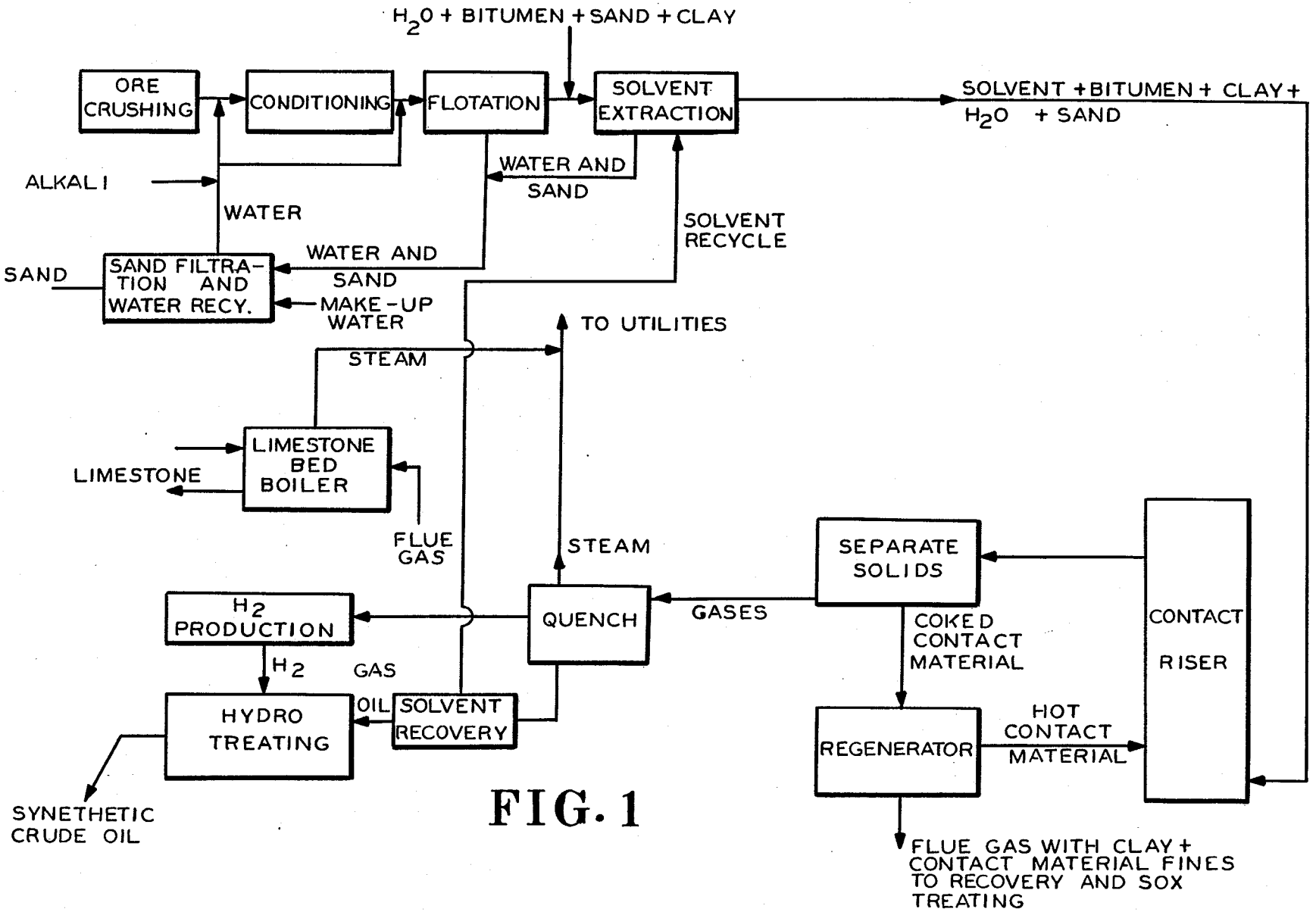
FIG. 1 is a schematic diagram of a tar sands bitumen upgrading process incorporating selective vaporization and utilizing solvent employed in upgrading the bitumen as diluent for the bitumen in the selective vaporization contractor.

Referring to FIG. 1, crude tar sand bitumen ore is crushed, conditioned with alkali (e.g., sodium hydroxide) and water and subjected to flotation to produce as a float product a concentrate of bitumen mixed with water, sand and clay. The underflow from the flotation cell, a concentrate of sand and water, is charged to a filter for recovery of water which is reused in the flotation plant. The float product is then subjected to solvent extraction, using, for example, fuel oil in an amount roughly equal in weight to the weight of the bitumen. Without recovering the solvent in fractionation equipment, as in conventional tar sands bitumen beneficiation, the solvent diluted mixture of bitumen, clay, water and possibly sand, is circulated through the contactor riser/regenerator system shown in detail in FIG. 2. The regenerator (burner), discussed below in connection with the description of FIG. 2, operates with cyclones and high velocity air which attrites clay deposited on the fluidizable particles of hot contact material circulating in the system. The flue gas from the regenerator therefore contains attrited clay as well as fines resulting from physical breakdown of contact material. These fines are recovered in conventional means such as baghouses after separation from the flue gases which are handled in equipment suitable to remove oxides of sulfur before discharge to the atmosphere.

In the process shown in FIG. 1, product from the selective vaporization riser, after quench and fractionation to separate the solvent and gas from the syncrude, is passed to a hydrotreating facility to produce a synthetic crude oil. Solvent liquified and separated after the quench is recycled to the solvent extraction plant. Flue gases from the regenerator are processed to remove oxides of sulfur in a limestone bed boiler and steam recovered during this operation is used to operate utilities. The gas produced in the selective vaporization riser is used to provide hydrogen for the hydrotreater.

In general, an initial charge of fluidizable contact material is made to circulate into the contacting zone, into the burning zone and again into the contacting zone prior to the introduction of feedstock. A combustive material, such as what is sometimes referred to as "torch oil", is charged to the selective vaporization process burning zone to initiate combustion. This material may be a waste product from a refinery. The heat of combustion of this material warms the system to the operating temperature range. Feedback is then introduced and torch oil injection discontinued.

As noted earlier, the residual colloidal clay content of bitumen derived from tar sand has in the past proved to be a major problem in the subsequent upgrading of these tar sands. One of the advantages of the instant invention is that these colloids do not have any negative impact upon the selective vaporization process because the colloids are continuously removed from the system. This bitumen feed may comprise a crude bitumen concentrate prepared by extraction or one which has been subjected to some additional treatment, such as solvent upgrading.

For treatment of the initial bitumen charge as well as for use throughout the selective vaporization process, the calcined kaolin clay microspheres described in the above-noted U.S. Pat. No. 4,263,128 would be suitable. Other solids of low catalytic activity, low surface area and similar particle size may also be employed. In general, solids of low cost are recommended, as it is necessary to discard a portion of the contact material on a continuous or semi-continuous basis and replace it with fresh material to maintain a suitable metals level. In some cases, a portion of the contact material is residual plus 20 microns sand contained in the initial bitumen charge and derived from the crude tar sands as mined.

The heat requirements of the system are supplied essentially by the heat of combustion of the coke deposited on the contact material during the vaporization process. These requirements inlcude the heat necessary to bring the various components of the feed (hydrocarbonaceous material, entrained water and any sand, etc.) to the contactor temperature and the heat of vaporization and reaction of the various hydrocarbon feed components. The regenerator heat requirements must also be considered. These include the heat necessary to bring air, contact material and the deposited coke to the regeneration temperature. Finally, some allowance must be made for heat loss to the environment. Through evaluation of these heat balance requirements of the system, it has been determined that raw bitumen charge containing optionally up to about 7.5% by weight sand relative to the bitumen can be treated through the selective vaporization process with a practical minimum conversion to coke equivalent to about 80% of the Conradson Carbon value. Moreover, upwards of 300% by weight sand in the bitumen charge could be accommodated, albeit with a higher production of coke. The bitumen charge may also contain substantial amounts of water. For the limiting case in which the sand content of the feed is minimal and the conversion to coke is equivalent to 80% of the CC value, at least 14 weight percent of the charge based on the bitumen may be water, and as much as about one-half of the charge as water can be accommodated with an acceptable level of coke production.

The selective vaporization process is characterized by short residence times of the charge in the contactor. As used herein, hydrocarbon residence time is calculated as length of the contactor from the charge introduction point to the point of separating solids from vapors divided by the superficial linear velocity at the solids separation point, thus assuming that linear velocity is constant along the contactor. The assumption is not strictly accurate but provides a highly useful measurement. As so measured, the hydrocarbon residence time will be less than 5 seconds and preferably less than 3 seconds when applying the process to best advantage. Since some cracking, particularly of the deposit on the inert solid, will take place at the preferred temperatures for bitumens, the extent to which residence time can be reduced is often limited by characteristics of the equipment employed. If the equipment permits, residence times of less than 2 seconds are preferred and residence times of less than one second are most preferred.

In general, the selective vaporization process is carried out under temperatures and pressures corresponding to those currently used in selective vaporization of heavy crudes and distillation residua thereof. The contact material is generally heated above about 1100° F.; the upper temperature limit is determined by the particular burner employed and rarely exceeds 1800° F. When impacted by the charge, the contact material has in most cases a temperature of at least 800° F.; temperatures above 850° F., and most particularly in the range of 900°–1050° F., are preferred. The operating pressures in the system are preferably as low as possible. This pressure rarely exceeds 50 psia, and is usually about 20–35 psia.

The instant invention is preferably conducted in a contactor very similar in construction and operation to the riser reactors employed in modern fluid catalytic cracking (FCC) units. Bitumen charge prepared according to the cold or hot water preocesses described above, diluted with an equal weight of low boiling hydrocarbon diluent such as kerosene and containing about 2500 ppm to 7 wt % colloidal clay based on the bitumen, is introduced at the lower end of a vertical conduit. Unless sufficient solvent used to refine the upgraded tar sands remains with the bitumen, additional volatile material, such as light hydrocarbon recycled in the process, steam, gas and/or water, is added in amounts sufficient to decrease substantially the hydrocarbon partial pressure of the feedstock. The pressure in the system should be sufficient to overcome pressure drops, and is generally on the order of 20 to 50 psia. The charge may be preheated in a heat exchanger or a furnace before introduction to the contactor. This preheating may be to any desired temperature below thermal cracking temperature. Typically, the charge may be heated to about 200°-800° F., and preferably to about 300°-700° F. Higher temperatures would induce thermal cracking of the feed, with the result being increased production of low valued product.

Figure 2:
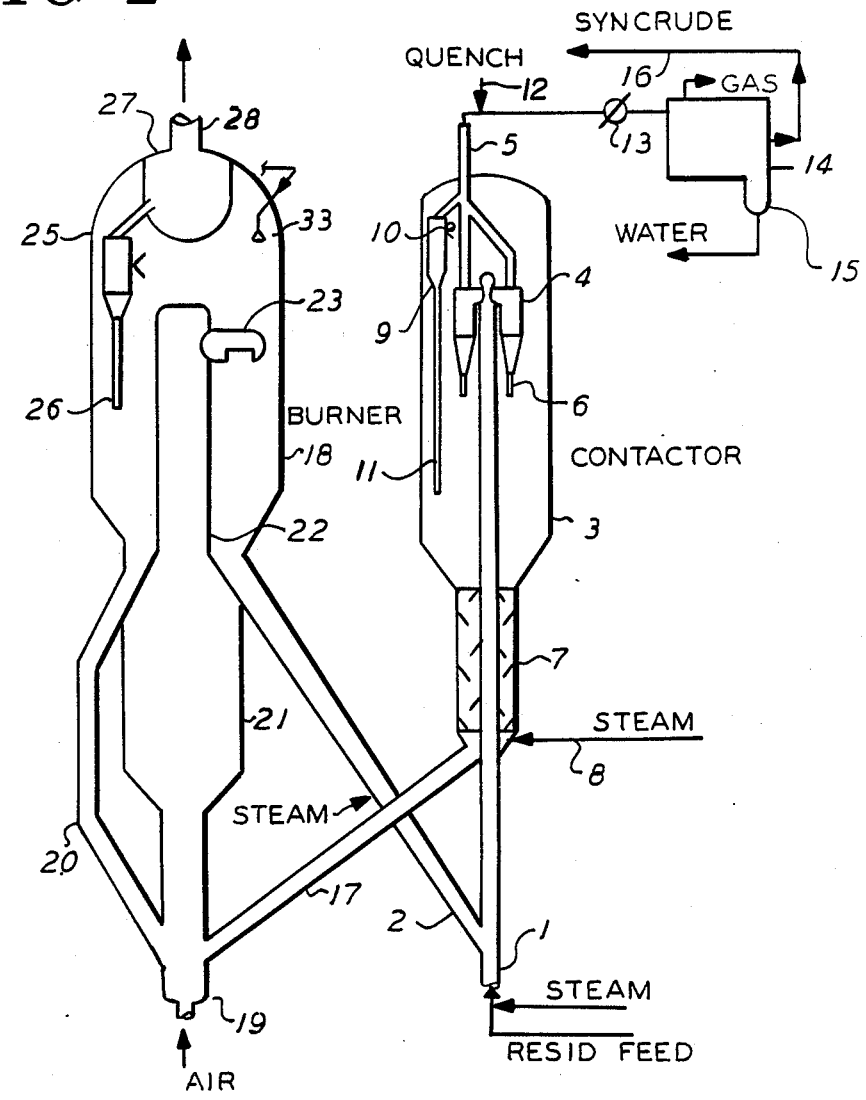
FIG. 2 is a diagramatic sketch of a selective vapor system for upgrading tar sand bitumen concentrates in a riser/burner system.

With reference to the accompanying FIG. 2, the feed, optionally further diluted by light hydrocarbons, steam or the like, rises in the contactor 1 at high velocity, such as for example 40 feet per second. Hot inert solid in finely divided form is introduced into the feed from a standpipe 2 in a quantity sufficient to provide a mixure at a suitably elevated temperature which causes deposition of all components of high CC number and high metal content onto the contact material and volatilization of lighter, hydrogen rich hydrocarbons.

The length of the contactor 1 is such to provide a short residence time for contact between the feed and the contacting agent. This is preferably on the order of 3 seconds or less, more preferably about 2 seconds, and most preferably 1 second or less. The residence time, however, should be sufficiently long to allow for good uniformity of contact between the feed and the contacting agent, i.e., at least about 0.1 second. The residence time is calculated on the basis of the vapor residence time determined from outlet conditions.

At the top of the contactor, e.g., about 30 to 40 feet above the point of introduction of contacting agent from standpipe 2, vaporized hydrocarbons are separated as rapidly as possible from particulate solids bearing the high CC deposits and metals. This may be accomplished by direct discharge from the contactor into a large disengaging zone defined by vessel 3. It is however, possible that the contactor discharge the product directly into cyclone separators 4 from which vapors are transferred to vapor line 5. Entrained solids drop into the disengaging zone by diplegs 6 to a stripper 7. Steam and/or hydrocarbons admitted to stripper 7 by line 8 evaporate traces of volatile hydrocarbons from the solids.

The mixture of steam and hydrocarbons, together with entrained solids, enters cyclone 9 by opening 10 to disengage the suspended solids for return to stripper 7 by dipleg 11. As is well known in the art, a plurality of cyclones 4 and 9 may be used. These cyclones may be multistage, with gas phase from a first stage cyclone discharging to a second stage cyclone.

The cyclones may be of the stripper cyclone type described in U.S. Pat. No. 4,043,899. In this case, the stripping steam admitted to the cyclone may be at a relatively low temperature, such as 400°-500° F., and may serve to perform part or all of the quenching function presently to be described. Alternatively, superheated steam or gas may be introduced to keep the products from condensing before an external quench. A system of preference in the present invention is the vented riser described in Meyers et al., U.S. Pat. Nos. 4,006,533 and 4,070,159.

The vaporized hydrocarbon from cyclones 4 and 9 passing by way of line 5 is then mixed with cold hydrocarbon liquid introduced by line 12 for the purpose of quenching thermal cracking. The quenched product is cooled in condenser 13 and passed through accumulator 14. Gases are removed from fuel from accumulator 14, and water, if any, is taken from sump 15, preferably for recycle to the contactor for generation of steam to be used as an aid in vaporizing charge at bottom of the riser and/or for removing heat from the burner. Condenser 13 may be advantageously set up as a heat exchanger to preheat charge to the contactor or to the FCC unit employed subsequently.

In one embodiment, quenching is advantageously conducted in a column equipped with vapor-liquid contact zones such as disc and doughnut trays and valve trays. Bottoms from such a column quencher could go directly to catalytic cracking or hydrotreating with overhead passing to condenser 13 and accumulator 14 or the overhead could be further fractionated to recover the solvent, recycle streams, and naphtha, gas and water from accumulator 14.

Certain advantages can be realized in the system by the use of recycled light hydrocarbons at the bottom of contactor 1 for further vapor pressure reduction if the solvent is present in amount sufficient to reduce the viscosity of the bitumen to an acceptable level but is not present in amount to achieve the desired reduction in hydrocarbon vapor pressure. Recycle of water from accumulator 14 for this purpose requires that the effluent of the contactor be cooled to the condensation point of water. In this water vapor/hydrocarbon vapor system, that temperature would be about 150° F. When hydrocarbons are used for pressure reduction and as the stripping medium at line 8 condensation becomes unnecessary when only small amounts of water are associated with the bitumen. In particular, the use of hydrocarbon both as diluent and for vapor pressure reduction allows for efficient recycling of this material. The contactor effluent may be passed directly to a catalytic cracking reactor. In this case, the contactor also functions as the catalytic cracking preheat furnace.

The light hydrocarbons chosen to boil below the temperature in contactor 1 for use both as diluent and as means for vapor pressure reduction are preferably recycled in the process. While for purposes of vapor pressure reduction, light hydrocarbons such as naphtha, kerosene and/or gas oil fractions derived from the process may be employed, the use of the gas fraction derived from the process is preferred. In particular, the use of these liquid solvents during the separation of bitumen from the raw tar sand and their retention in the selective vaporization feedstock leads to an especially efficient system.

The liquid hydrocarbon phase from accumulator 14 is a desalted, decarbonized and demetallized fraction which, after removal of any entrained particulate sand not removed by cyclones 4 and 9, would be satisfactory charge for catalytic cracking or, where desired, hydrotreating to increase the hydrogen content. This product of contact in contactor 1 may be used in part as the quench liquid at line 12. The balance is preferably transferred directly to a subsequent refining stage via line 16. This product may be optionally treated with a particulate separation means prior to refining.

In stripper 7, the catalytically inert solid particulate material, bearing a discontinuous coating of particles of colloidal clay, passes by a standpipe 17 to the inlet of burner regenerator 18. Most commercial regeneration unit designs operate with air distributors in the combustor as a jet at 125 to 400 feet per second (fps). As material is charged perpendicularly into the regenerator into contact with air jets at 125–400 fps the effect will be a combination of a fluid energy mill and a ball milling action, the latter taking place by particle-to particle contact. Assuming circulation of fresh ARTCAT contact material at 4#/# feed, there will be 400# ARTCAT/# clay when operating with a bitumen feed containing 1 wt % clay. This will provide an ample number of collisions to remove protuberances of deposited colloidal clay before it can build up into a dense, attrition resistance shell.

This inert contact material also bears a deposit of high CC and metallic content material. Standpipe 17 discharges to a riser 19 where it meets a rising column of air introduced into line 19. The spent particles are mixed with hot inert particles from burner recycle 20, whereby the mixture is rapidly raised to a temperature for combustion of the deposits from treating the bitumen, e.g., 1200°-1600° F. The mixture enters an enlarged zone 21 to form a small fluidized bed for thorough mixing and initial burning of deposits. The flowing stream of air carries the burning mass through a restricted riser 22 to discharge at 23 into an enlarged disengaging zone. The hot burned particles, now largely free of combustible deposit, fall to the bottom of the disengaging zone, burner 18. A portion of the particles is introduced into recycle 20. Another part enters standpipe 2 for supply to contactor 1 after steam stripping. Because of the high temperatures which can be obtained in this type of burner, CO will burn to provide a flue gas containing very little of that gas in the presence of a stoichiometric excess of oxygen. In other types of burners, the combustion products may contain substantial amounts of CO which can be burned for its heating value in CO boilers of the type commonly used in FCC units.

In the type of burner shown, the gaseous products of combustion, containing carbon dioxide, some residual oxygen, nitrogen, oxides of sulfur and nitrogen, and perhaps trace CO, enter a cyclone 25 to disengage entrained solids for discharge by dipleg 26. As is known in the art, a plurality of such cyclones may be used. The clarified gases pass to a plenum 27 from which flue gas is removed by outlet 28.

Although the system just described bears a superficial resemblance to an FCC unit, its operation is very different from that of an FCC system. Of greatest significance is the fact that the contactor 1 is operated in such a manner as to remove from the charge an amount not greatly in excess of the equivalent of twice the Conradson Carbon value of the feed. This is achieved by the very low severity cracking due to the inert character of the solid and very short residence time at cracking temperature. It is generally recognized that cracking severity is a function of time and temperature. Accordingly, increased temperature may be compensated for by reduced residence time, and vice versa. Ideally, no more than 120% of the CC equivalent is removed from the charge in the form of coke. The practical lower limit for the selective vaporization of bitumen is about 80% of the CC equivalent.

The selective vaporization process affords a control aspect not available to FCC units in the supply of hydrocarbons or steam to the contactor. When stocks of high CC number are processed, the burner temperature will tend to rise because of increased supply of fuel to the burner. This may be compensated for by increasing the amount of hydrocarbons and/or steam supplied to reduce initial pressure of hydrocarbons in the contactor or by recycling water from the overhead receiver to be vaporized in the contactor to produce steam.

After transistor via line 16, the hydrocarbon product may be introduced to the feed line of an FCC reactor operated in the conventional manner. Because the FCC unit provides a product under normal operations containing some fines generated through abrasion of the contact material, it has been generally necessary to employ some means of physical separation to remove these fines in the FCC unit itself. Accordingly, the charge to the FCC unit need not be treated to remove entrained mineral particles prior to charging.

When the products of selective vaporization of bitumen are to be subjected to a hydrogen addition treatment, removal of most of the entrained solids should be caried out in order to minimize pore blockage of the hydrogenation catalyst and blockages in the hydrogen addition unit. It is particularly advantageous to collect the selective vaporization products with any entrained fine mineral particles in a settling tank prior to hydrotreating. The bottoms from this settling tank could be fed directly into a catalytic cracker, burned in the regenerator or simply removed from the system. The ligher fraction, referred to as "clarified oil38, is substantially free of entrained solids; any remaining particles are then removed by conventional means, such as centrifuging or electronic separation. These known methods for removal of solids provide hydrotreating charge containing as little as 500 ppm fines or less.

In some cases, it may be desirable to subject the hydrocarbon product to a hydrocracking treatment. This form of high severity hydrotreating simultaneously induces molecular conversion, desulfurization and denitrification. It is carried out at much higher pressures than a standard hydrotreating as used to saturate double bonds in the hydrocarbon product, and generally requires a significantly greater hydrogen input as well. Material which is to be hydrocracked should also be subjected to a preliminary treatment to remove substantially all of the fines.

Yet another method for production of useful hydrocarbon products from the selective vaporization product is vacuum distillation in a so-called "vacuum tower". The bottoms from the tower, generally comprising materials boiling above 1000° F., may be used to prepare heavy fuel oil, such as Bunker C and No. 6 oils. The fraction boiling at 600°-1000° F. can be subjected to conventional hydrotreating for further upgrading, or catalytic cracking to prepare high octane products.

The terms and expressions which have been employed are used as terms of description and not of limitation, and there is no intention in the use of such terms and expressions of including any equivalents of the features shown and described or portions thereof, but it is recognized that various modifications are possible within the scope of the invention claimed.

The following examples are given to illustrate certain aspects of the invention.

EXAMPLE I

This example demonstrates that removal of colloids deposited on contact material from tar sands bitumen in a selective vaporization process prior to circulating the contact material to renewed contact with incoming charge of tar sand bitumen feedstock is desirable.

Solvent-diluted tar sands bitumen were used in a selective vaporization process carried out in a conventional pilot plant FCC riser-regenerator system. The regeneration air was introduced through a fritted air distribution system; consequently, there was no provision to induce attrition and a ball milling action to remove colloids deposited on the contact material (microspheres of calcined kaolin clay) prior to recirculating contact material to the contactor. Thus, in the pilot plant tests, the deposited colloids were able to build up as a dense shell on the particles of contact material.

The properties of the bitumen prior to dilution with solvent are set forth in Table I. The chemical composition of the ash in the bitumen is detailed in Table II.

The chemical, physical and catalytic properties of the equilibrium bitumen contact material sample used to heat the bitumen are presented in Table III. For comparison purposes, representative values for fresh contact material are also included in the tables, along with representative values for equilibrium contact materials used in selective vaporization of crude oil fractions.

Comparison of the chemical analyses (Table II and Table III) of the bitumen treated equilibrium contact material sample and the bitumen ash clearly indicates that a large fraction of the ash, especially iron, titanium, calcium and sulfur, has been incorporated into the microsphere sample. In addition, the surface area and micropore volume of the sample of contact material used to treat the bitumen were significantly higher than either fresh or equilibrium contact material which had been used for selective vaporization of residual fractions of petroleum (resid contact material sample). These changes in the phsyical and chemical nature of the sample are presumed to be responsible for its higher catalytic activity in MAT test results (Table IV). The high MAT conversion values for the bitumen treated contact material sample are from high yields of $C_3$ and $C_4$ (primarily olefins), and gasoline. The low yields of $C_1$ and $C_2$ and coke products suggests that the hydrocarbon products results from acid cracking rather than thermal cracking or metal dehydrogenation reactions. The high sulfur content on the regenerated bitumen contact material sample is also quite unusual. The sulfur is probably present as thermally stable sulfate compounds. The particle size distribution is typical of equilibrium selective vaporization contact materials (low levels of −40 micron material).

Several representative SEM photographs were taken, and EDX (energy dispersive x-ray) analyses of the bitumen sample contact material are presented in Table V. Only clay-based microspheres were present. Apparently the ash material was so fine that no large (50–70 micron) particles were formed. The surface roughness, protrusions and irregularly-shaped particles which were observed on the microspheres surfaces are very unusual for an equilibrium contact material and have not been observed in samples used to treat residual oils. The close match of the chemical properties of the surface particles on the microspheres and the bitumen ash clearly indicates that the bitumen ash has deposited on the exterior surfaces of the contact material during the selective vaporization process operation.

EXAMPLE 2

The test work described in this example suggests that selective-attrition will be effective for removal of ash contaminants deposited on contact material during the upgrading of clay contaminated tar sand bitumen by selective vaporization.

A sample of the equilibrium calcined kaolin clay contact material used in the pilot plant test run of Example 1 was subjected to attrition to determine whether deposited ash could be selectively attrited from the microspheres of calcined kaolin clay. As shown in Table III, the fresh contact material (microspheres of calcined kaolin clay) analyzed approximately 45 wt % $Al_2O_3$, 52 wt % $SiO_2$, 2 wt % $TiO_2$, less than 1% iron oxide and negligible calcium. The analysis of the equilibrium contact material including ash deposit also appears in Table III under the legend "Bitumen Contact Material Sample" and shows appreciably higher levels of iron, titanium and calcium than were present in the contact material.

Since the run in which the ash was deposited on contact material was carried out in a pilot unit not equipped with means to attempt to continuously attrite the ash deposit during regeneration, the effort to determine the response of the equilibrium material to a high velocity air jet was carried out in a Roller Attrition test unit. This Roller attrition test is well known in the FCC industry where it is used to determine the attrition resistance of samples of fluid cracking catalyst. The Roller test applies a high velocity air jet to a sample located in a U-tube below a cyclone. After the application of the high velocity air, the attrited material which passed through the cyclone was collected in a filter. The attrited material was recovered and analyzed by SEM-/EDX techniques, insufficient material being available for complete chemical analysis or to make a material balance.

The attrited material was found to consist of two general types of particles, i.e., shell pieces of the order of about 10 microns or less in size and fine dust. SEM analysis of the microspheres remaining after removal of attrited material in the Roller unit showed evidence of cracking and partial removal of the shell. The chemical composition of the attrited components, expressed as oxides, are set forth below:

| wt. % | Shell Pieces | Fine Dust |
|---|---|---|
| $Na_2O$ | — | 0.44 |
| MgO | 4.95 | — |
| $Al_2O_3$ | 13.83 | 37.93 |
| $SiO_2$ | 23.87 | 51.36 |
| $P_2O_5$ | 5.09 | 1.16 |
| $SO_3$ | 4.35 | 0.76 |
| Cl | 0.14 | — |
| $K_2O$ | 0.63 | 0.57 |
| CaO | 20.27 | 2.94 |
| $TiO_2$ | 11.16 | 2.79 |
| $Fe_2O_3$ | 15.70 | 2.05 |

Only qualitative conclusions could be drawn since, as mentioned, there was not sufficient material to make complete chemical analyses and material balances. However, by comparing the results of the SEM/EDX investigations with chemical analyses of the contact material before the deposit of ash (Table III), it appears that the attrited materials were enriched in calcium, iron and titanium. Enrichment was especially evident in the case of the shell pieces. As mentioned, the remaining microspheres exhibited evidence of cracking and partial removal of the shell. These results suggest that the ash deposit was selectively attrited by application of the air jet.

EXAMPLE 3

A Utah, USA tar sand bitumen has been treated in an ART process unit pilot plant to produce an upgraded synthetic crude. This extremely heavy material had an API of 9.3° and contained 1.2 wt % mineral matter. Table VI summarizes expected commercial unit yields based on pilot plant tests adjusted for heat balance and providing for continuing removal by attrition of deposited colloid.

To illustrate the dramatic change in boiling range which took place in processing of this tar sand bitumen we have illustrated in FIG. 3 the distillation curves of the synthetic crude product and the bitumen feedstock. FIG. 3 shows estimated true boiling point distillation and API gravity curves of the products and feedstock (distillation only). Most interestingly the bitumen feedstock had an initial boiling point of about 482° C. (900° F.). The synthetic crude was substantially lighter, 70 Vol. % of which boiled below the initial boiling point of the bitumen feedstock. Very important was the fact that the 565° C.+(1050° F.+) portion of the synthetic crude amounted to only 12 Vol. % of the synthetic crude oil. This fraction, corresponding to vacuum residum, comprised about 92 Vol. % of the bitumen feedstock. In fact, comparing the synthetic crude oil which would be produced from the bitumen with heavy Arabian crude oil indicates that the synthetic crude, being of much lower contaminant content and having much more distillate range material, could be of significantly higher value.

TABLE I

TAR SANDS BITUMEN FEED PROPERTIES

| | |
|---|---|
| °API | 10 |
| Sulfur | 0.4 wt. % |
| Ramsbottom Carbon | 16 wt. % |
| Nickel | 60 wppm. |
| Vanadium | 10 wppm. |
| Ash | ca. 1 wt. % |

TABLE II

TAR SANDS BITUMEN ASH COMPOSITION

| | |
|---|---|
| CaO | 23.5 |
| $Fe_2O_3$ | 15.1 |
| $TiO_2$ | 14.7 |
| $SO_3$* | 11.1 |
| $SiO_2$ | 10.5 |
| MgO | 6.5 |
| $Al_2O_3$ | 5.1 |
| $K_2O$ | 1.1 |
| $Na_2O$ | 0.9 |
| | 88.5** |

*It is believed that the presence of $SO_3$ may be derived from incomplete decomposition of sulfur compounds in the hydrocarbon portion of the bitumen.
**It is believed that carbonate was also present in the sample but was not accounted for in making the analysis.

TABLE III

CHEMICAL AND PHYSICAL PROPERTIES
EQUILIBRIUM SELECTIVE VAPORIZATION CONTACT MATERIALS

| Chemical Analyses (wt. %) | Bitumen Contact Material Sample | Fresh Contact Material | Equilibrium Resid Contact Material Sample |
|---|---|---|---|
| LOI | 3.54 | 1.0 | 0.15 |
| $Al_2O_3$ | 44.03 | 45.10 | 44.59 |
| $SiO_2$ | 47.10 | 51.72 | 51.95 |
| $Na_2O$ | 0.51 | 0.45 | 0.91 |
| $Fe_2O_3$ | 1.82 | 0.40 | 1.10 |
| $TiO_2$ | 2.71 | 1.90 | 1.87 |
| $K_2O$ | 0.17 | 0.10 | — |
| CaO | 2.19 | 0.05 | — |
| MgO | 0.52 | 0.03 | — |
| $P_2O_5$ | 0.63 | 0.45 | — |
| Ni (ppm) | 625 | — | 1300 |
| V (ppm) | 1620 | — | 2400 |
| Leco C wt. % (as is) | 0.02 | — | .02 |
| Leco S wt. % (as is) | 1.32 | — | — |
| Mullite Index | 7 | 4 | — |

TABLE III-continued

CHEMICAL AND PHYSICAL PROPERTIES
EQUILIBRIUM SELECTIVE VAPORIZATION CONTACT MATERIALS

| | | | |
|---|---|---|---|
| BET S. A. ($m^2/g$) | 16.0 | 8.6 | 7.8 |
| $N_2$ Pore Size Dist. 100 A | .02 | .004 | — |
| 100–600 A (cc/g) | .04 | .05 | — |
| Hg Pore Volume (cc/g) (100–20,000 A dia) | 0.20 | 0.25 | 0.17 |
| Particle Size Distribution | | | |
| | Bitumen | Fresh | Crude |
| Micron Size: | | | |
| 0–20 | 2 | 4 | 1 |
| 0–40 | 3 | 14 | 6 |
| 0–60 | 12 | 37 | 24 |
| 0–80 | 40 | 59 | 47 |
| Avg. Part. Size (micron) | 86 | 71 | 82 |

TABLE IV

MAT RESULTS
SELECTIVE VAPORIZATION CONTACT MATERIALS

| MAT Yields (wt. %) | Bitumen Contact Material Sample | Fresh Contact Material | Equilibrium Contact Material Sample |
|---|---|---|---|
| Conversion | 23.19 | 7.0 | 6.1 |
| $H_2$ | 0.13 | 0.06 | 0.12 |
| $C_2$ | 0.56 | 0.50 | 0.69 |
| $C_3 + C_4$ | 2.20 | 0.70 | 1.1 |
| $C_5$–421° F. | 18.38 | 5.0 | 3.0 |
| 421–602° F. | 23.95 | 22.41 | 25.1 |
| 602+ | 52.86 | 70.54 | 68.90 |
| Coke | 2.05 | 0.85 | 1.30 |
| | (Average of 2 runs) | (Average of 2 runs) | (Average of 2 runs) |

TABLE V

EDX ANALYSIS
BITUMEN SAMPLE CONTACT MATERIAL

| Oxide Component | Wt. % |
|---|---|
| A. Overall Microsphere Composition: | |
| MgO | 3.24 |
| $Al_2O_3$ | 10.79 |
| $SiO_2$ | 30.31 |
| $P_2O_5$ | 3.41 |
| $SO_3$ | 9.13 |
| CaO | 14.60 |
| $TiO_2$ | 7.76 |
| $V_2O_5$ | 0.46 |
| $Fe_2O_3$ | 9.97 |
| CuO | 0.31 |
| B. Protuberance Composition: | |
| MgO | 2.41 |
| $Al_2O_3$ | 30.42 |
| $SiO_2$ | 39.71 |
| $P_2O_5$ | 1.63 |
| $SO_3$ | 2.61 |
| $K_2O$ | 0.12 |
| CaO | 3.69 |
| $TiO_2$ | 1.66 |
| $V_2O_5$ | 0.37 |
| $Cr_2O_3$ | 0.38 |
| MnO | 0.19 |
| $Fe_2O_3$ | 16.79 |

TABLE VI

TAR SAND BITUMEN YIELDS
Expected commercial unit yields based on pilot plant tests and adjusted for heat balance.

| | |
|---|---|
| $C_2$ | 3.2 |

TABLE VI-continued

| TAR SAND BITUMEN YIELDS<br>Expected commercial unit yields based on pilot plant tests and adjusted for heat balance. | |
|---|---|
| LPG | 2.7 |
| $C_5$-205° C.<br>($C_5$-400° F.) | 14.1 |
| 205° C.-345° C.<br>(400-650° F.) | 10.8 |
| 345° C.+<br>(650° F.+) | 56.4 |
| COKE | 12.8 |

We claim:

1. A process for upgrading a charge of a tar sand bitumen concentrate containing metal impurities, colloidal calcium-containing clay and water which comprises contacting said charge in a riser contacting zone in the presence of a low boiling organic solvent with hot fluidizable attrition-resistant substantially catalytically-inert microspheres which are 20 to 150 microns in diameter and are composed of previously calcined kaolin clay, said contact taking place at high temperature and short contact time which permits vaporization of the high hydrogen containing components of said bitumen, said period of time being less than that which induces substantial thermal cracking of said charge, at the end of said time separating said vaporized product from said microspheres of calcined kaolin clay, said mircrospheres of calcined kaolin clay now bearing a deposit of combustible solid, metal impurities and adherent particles of colloidal calcium-containing clay originally contained in said bitumen concentrate, immediately reducing the temperature of said vaporized product to minimize thermal cracking and recovering said product for further refining to produce one or more premium products, regenerating said microspheres of calcined kaolin clay with deposit of metal impurities, combustibles and colloidal calcium-containing clay by passing said microspheres to a regeneration zone using air jets at 125-400 feet per second to oxidize the combustible portions of the deposit, to heat said microspheres of calcined kaolin clay, and to subject said microspheres with said deposit to sufficient mechanical action to selectively attrite deposited colloidal calcium-bearing clay from said attrition-resistant microspheres of calcined kaolin clay without breaking up the microspheres of calcined kaolin clay, removing attrited colloidal calcium-bearing clay from said regeneration zone and recirculating the heated microspheres of calcined kaolin clay depleted at least in part of deposited colloidal calcium-bearing clay to contact with incoming bitumen charge in said contacting zone.

2. The process of claim 1 wherein said bitumen concentrate contains from 2500 ppm to 7 percent colloidal clay, based on the weight of said bitumen, calculated on a dry weight basis.

3. The process of claim 1 wherein said colloidal clay is present as an emulsion in said bitumen concentrate.

4. The process of claim 1 wherein said material removed by attrition is recovered in a bag house, cyclone or scrubber downstream from the burner regenerator.

5. The process of claim 1 wherein spent fluidizable microspheres are withdrawn on a continuous or semi-continuous basis in order to maintain a predetermined average metal content in the circulating contact material and to prevent, in conjunction with said attrition, the buildup of high levels of colloidal clay as a deposit on said microspheres.

6. The process of claim 1 wherein said tar sand bitumen concentrate is prepared by wet processing such as flotation or gravity separation.

7. The process of claim 1 wherein wet processed tar sand bitumen is further processed by solvent extraction to recover a bitumen concentrate.

8. The process of claim 7 wherein said charge is diluted with at least a portion of the solvent used in the purification to obtain said concentrate, whereby the amount of solvent that is removed by fractionation from said concentrate prior to contact with said heated fluidizable microspheres is reduced or eliminated.

9. The process of claim 1 wherein said charge is diluted with light gas oil and/or gas recovered from the vaporized product obtained by contact of a previous charge of tar sand bitumen concentrate with hot fluidizable microspheres.

* * * * *